US008800082B2

(12) United States Patent
Kluft et al.

(10) Patent No.: US 8,800,082 B2
(45) Date of Patent: Aug. 12, 2014

(54) MATTRESS CONSTRUCTION

(75) Inventors: Earl S. Kluft, Beverly Hills, CA (US); Jose ("Tony") G. Alvarez, Walnut, CA (US)

(73) Assignee: Earl S. Kluft, Beverly Hills, CA (US)

( * ) Notice: Subject to any disclaimer, the term of this patent is extended or adjusted under 35 U.S.C. 154(b) by 139 days.

(21) Appl. No.: 13/075,316

(22) Filed: Mar. 30, 2011

(65) Prior Publication Data

US 2012/0246833 A1 Oct. 4, 2012

(51) Int. Cl.
*A47C 23/04* (2006.01)

(52) U.S. Cl.
USPC ..... 5/717; 5/716; 5/718; 5/737; 5/739

(58) Field of Classification Search
USPC ..... 5/716–718, 737, 739
See application file for complete search history.

(56) References Cited

U.S. PATENT DOCUMENTS 4,449,261 A * 5/1984 Magnusson ..... 5/722
5,819,349 A * 10/1998 Schwartz ..... 5/740
7,165,282 B2 * 1/2007 Watson ..... 5/739
7,454,810 B2 * 11/2008 Wells ..... 5/727
7,640,611 B1 * 1/2010 Kluft ..... 5/716
2005/0000026 A1 * 1/2005 Gladney ..... 5/717
2006/0031995 A1 * 2/2006 Barkhouse ..... 5/690
2007/0044244 A1 * 3/2007 Ahn et al. ..... 5/721

OTHER PUBLICATIONS

E.S. Kluft Beyond Luxury brochure, Published 2008.

* cited by examiner

*Primary Examiner* — Robert G Santos
*Assistant Examiner* — Ifeolu Adeboyejo
(74) *Attorney, Agent, or Firm* — I. Morley Drucker; Thomas A. Runk; Fulwider Patton LLP

(57) ABSTRACT

A mattress assembly having a composite encasement surrounding a coil spring unit in which the composite encasement comprises alternating layers of canvas and foam, and in which a side border assembly of quilted material is attached to the exterior walls of the composite encasement by means of multiple, spaced, lines of stitching extending through the alternating layers of canvas and foam to firmly affix the side border assembly to the encasement.

18 Claims, 6 Drawing Sheets

MATTRESS CONSTRUCTION

CROSS-REFERENCES TO RELATED APPLICATIONS

None

BACKGROUND

The current state of the art, in the field of coil spring mattress construction, is shown in FIG. 1 and FIG. 2 of U.S. Pat. No. 7,640,611B1. FIG. 1 is a perspective and partial cut-away view of a mattress depicting various components of a mattress construction, and FIG. 2 is a cross-sectional view of the mattress of FIG. 1. FIGS. 1 and 2 are reproduced from my U.S. Pat. No. 7,640,611B1, which patent is incorporated herein in its entirety by this reference.

Referring to FIGS. 1 and 2, a generally planar base for the mattress 10 is constructed of a planar base foam layer 12 and fiberboard layer 14. Affixed along the perimeter of the base, by conventional gluing methods, are foam rails 16, rectangular in cross-section. The foam rails 16 form a rectangular all-foam encasement 18 (FIG. 1) defining a rectangular interior cavity 17 (FIG. 1), within which is placed a plurality of coil springs 19 (some of which are indicated by numeral 19 in FIG. 1), which are tied together, forming a coil spring unit 20. Each of the foam rails 16 have dimensions of approximately six inches (15.24 cm) in height and four inches (10.16 cm) in width, the lengths of the foam rails 16 being dictated by the desired size of the mattress.

A border assembly of fabric 22 including an outer layer of quilted material 23 is wrapped around the all-foam encasement 18 (FIG. 1) and attached to the outer sidewalls of the foam rails 16 by gluing and/or by means of divergent staples as described in U.S. Pat. No. 7,640,611B1.

While the all-foam encasement 18 and attached border assembly 22 are suitable for extended usage, there is a need in the ultra-premium class of mattresses for a construction which provides even more substantial border support, and which insures that the edges provided by the encasement remain straight and durable over time, in order to prevent sleeper roll off and dislodging of the border assembly, over time, due to the natural movement and weight of the sleeper on the mattress.

SUMMARY OF THE INVENTION

The mattress of our invention comprises a uniquely constructed multi-layer canvas-foam-canvas-foam canvas composite encasement rather than an all-foam encasement. The composite encasement of this invention is formed into a firm, but flexible and resilient unitary component of the mattress by means of a novel combination of double-sided adhesive tape and conventional gluing material. Such a composite encasement has substantially the same dimensions as the all-foam encasement of the mattress described in my U.S. Pat. No. 7,640,611B1.

The border assembly, which may be quilted and prestitched, is then wrapped around the perimeter of the multilayered composite encasement, and preferably affixed thereto, by means of stitching of the border assembly with a braided thread made of polyester, nylon or the like, at multiple points, throughout the entire composite encasement. The canvas layers prevent the mattress thread from cutting into the foam layers, which would otherwise occur due to the weight and movement of the sleeper on the mattress. The border assembly, thus attached to the composite encasement, does not shift, over time, and the edges of both the composite encasement and border assembly remain straight and sleeper roll off is minimized.

DETAILED DESCRIPTION OF THE PREFERRED EMBODIMENTS

Figure 1:
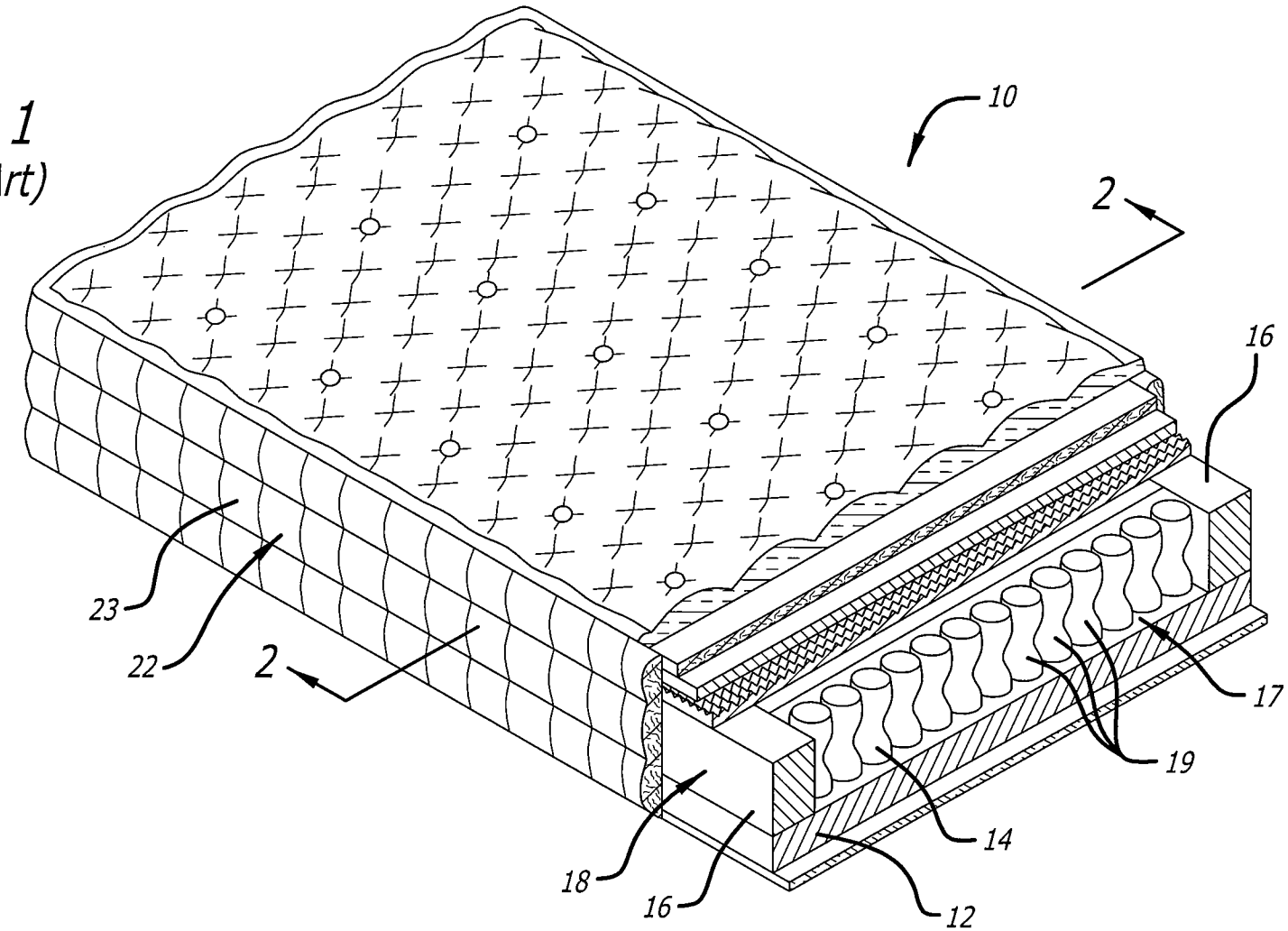
FIG. 1 (Prior Art)
FIG. 1 is a perspective and partial cut-away view depicting the various components of an assembled mattress described in U.S. Pat. No. 7,640,611B1.
Figure 2:
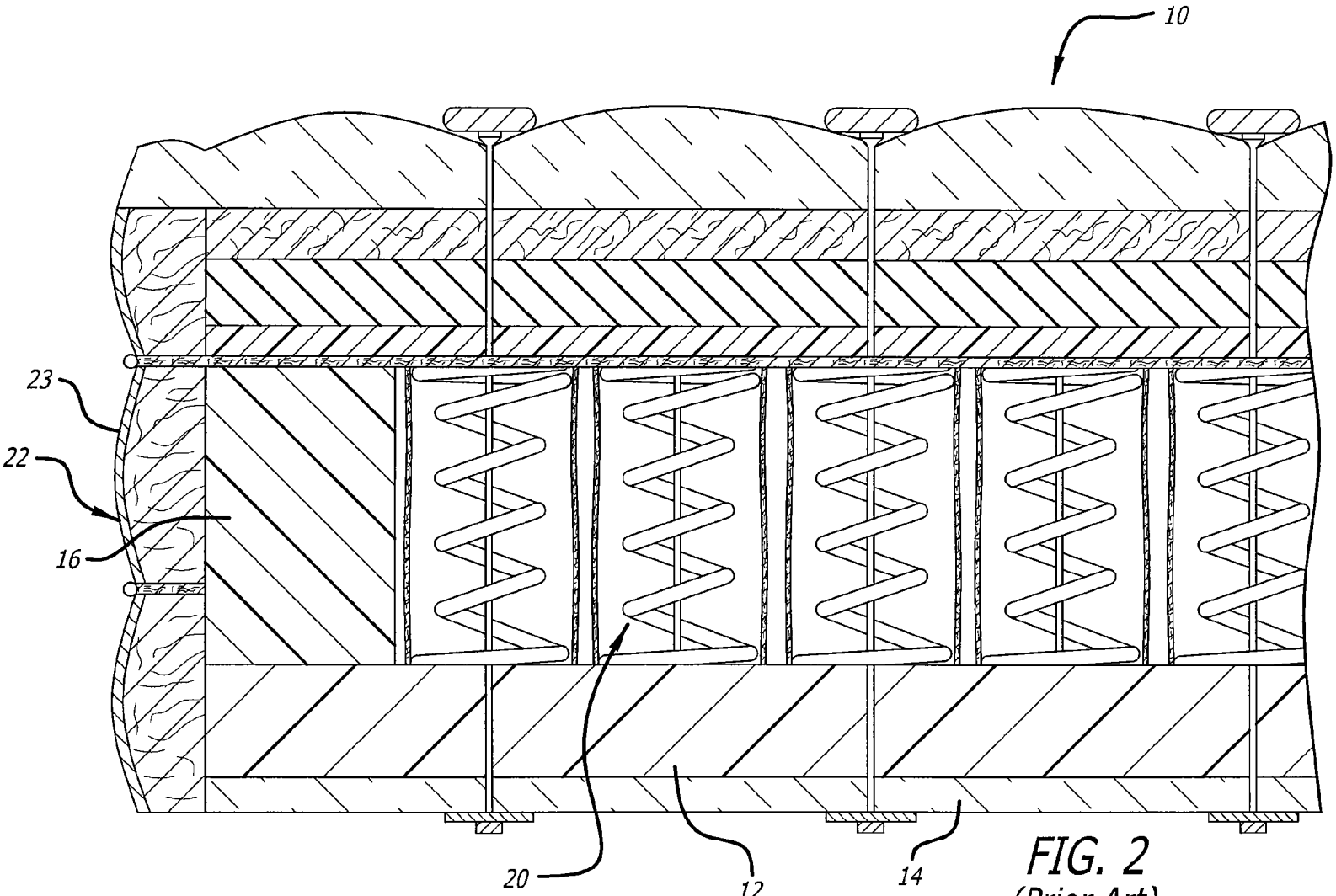
FIG. 2 (Prior Art)
FIG. 2 is a cross-sectional view taken along the line 2-2 of the mattress of FIG. 1.
Figure 3:
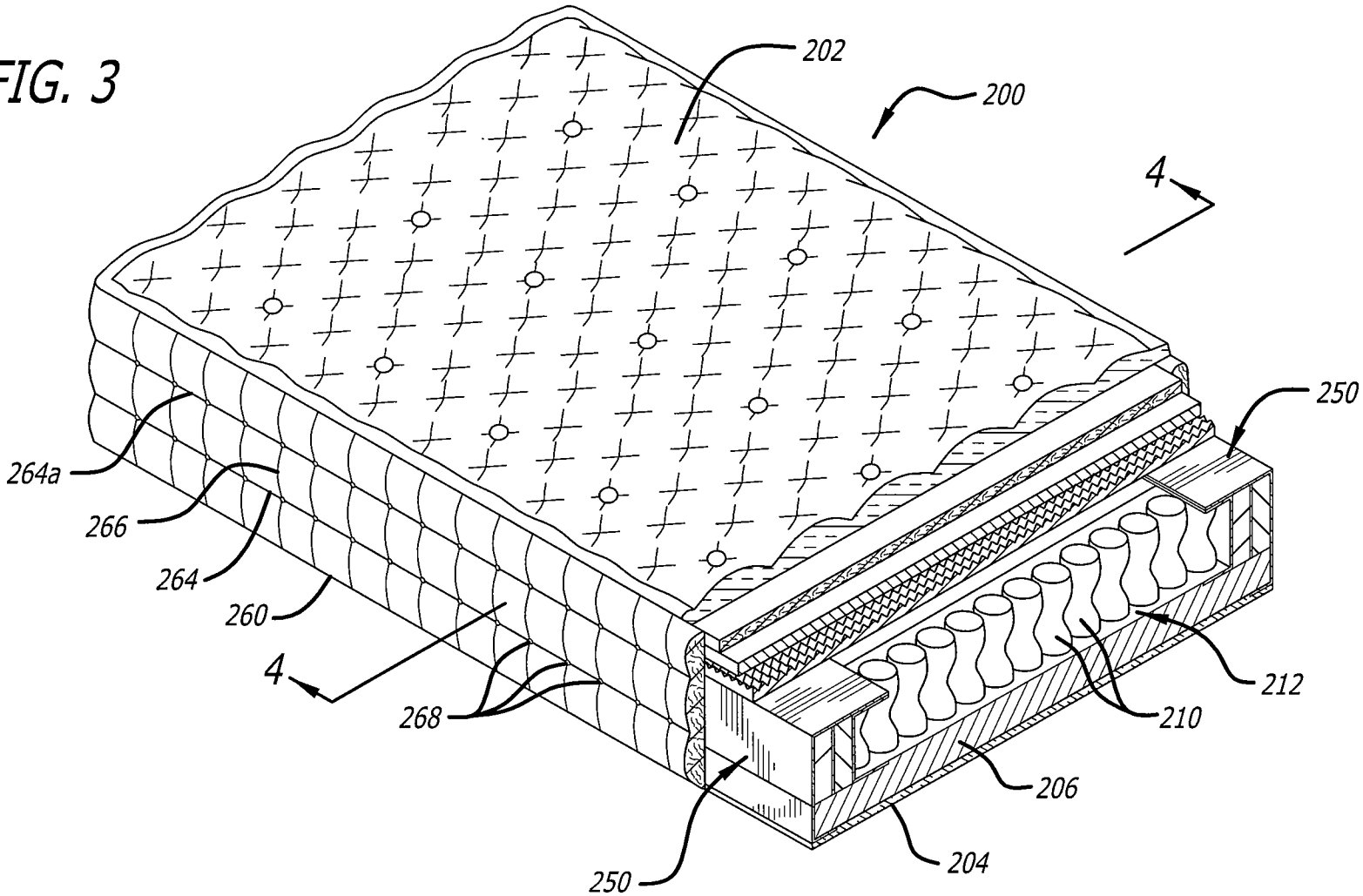
FIG. 3 is a perspective and partial cut-away view depicting the novel composite encasement of our invention.

Referring in particular to FIG. 3, there is shown a mattress 200 having an upper side or sleeping surface 202 and a lower or bottom surface comprising a planar fiberboard layer 204 upon which is affixed a planar foam base layer of material 206. The foam base layer 206 may comprise a conventional polyurethane foam material of suitable firmness or other conventional foam material.

Figure 4:
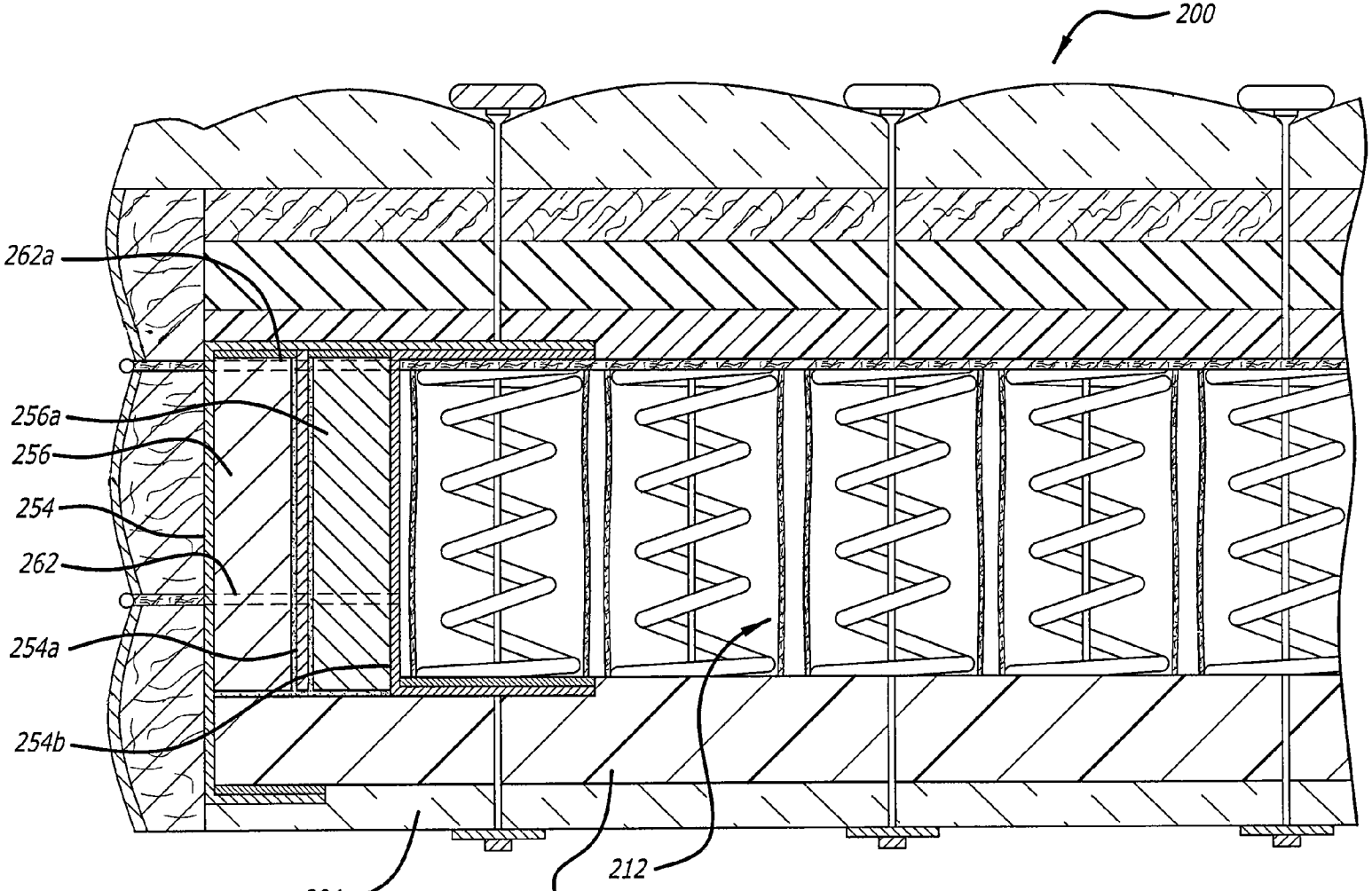
FIG. 4 is a cross-sectional view taken along the line 4-4 of FIG. 3, depicting the novel composite encasement and the attachment of the border assembly thereto.
Figure 5:
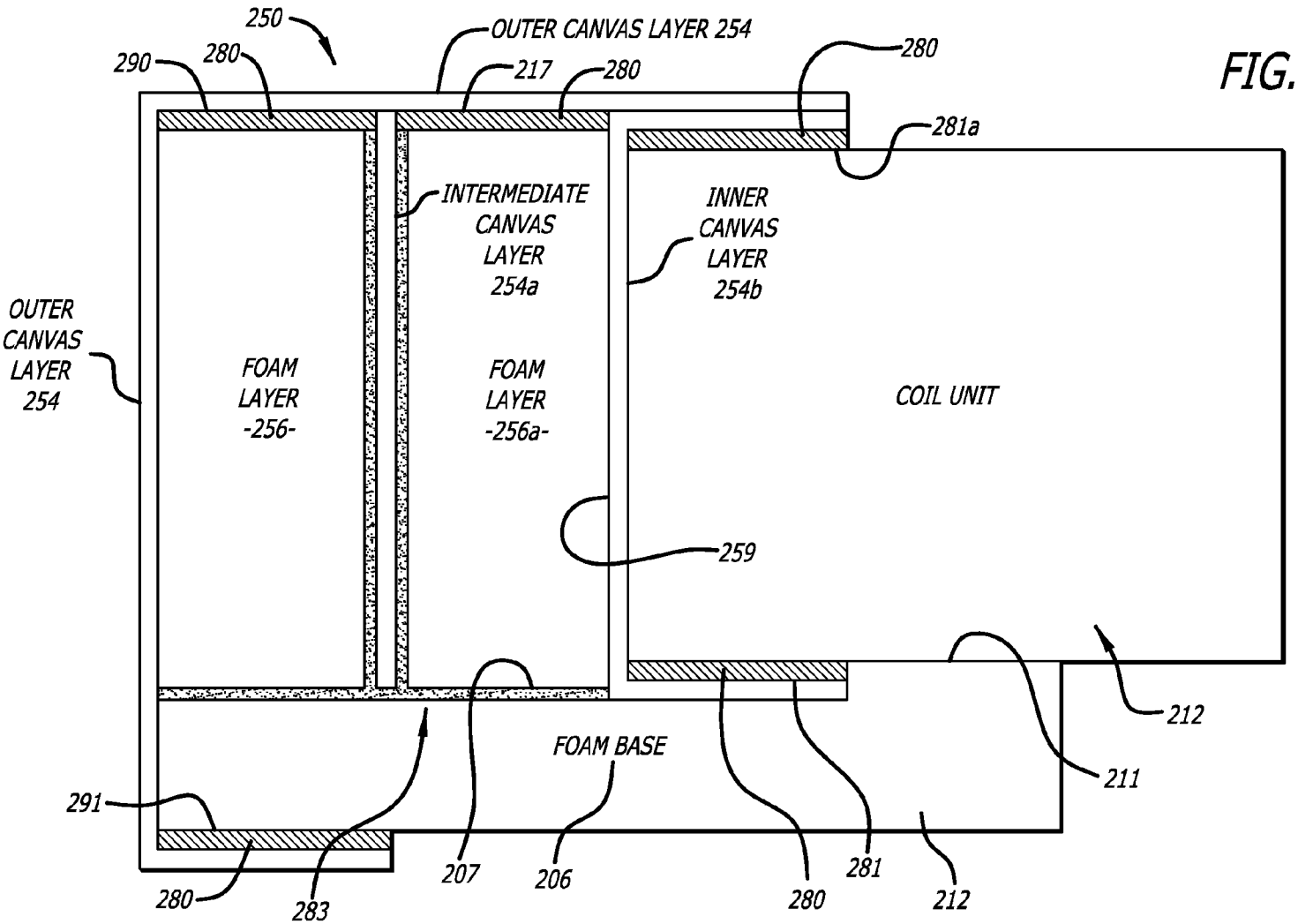
FIG. 5 is an enlarged, schematic, view of the composite encasement depicted in FIG. 4.

Referring now in particular to FIGS. 3, 4, and 5, the mattress 200 includes a novel encasement 250 affixed to the perimeter of the foam base layer 206 and extending upwardly therefrom. The encasement 250 defines an interior rectangular cavity within which is placed a plurality of coil springs 210, which are tied together to form a unitary coil spring unit 212, as further explained in U.S. Pat. No. 7,640,611.

Referring in particular to FIGS. 4 and 5, the novel composite encasement 250 is preferably constructed in the following manner: an inner canvas layer **254*b* is wrapped around the top, side and bottom of the perimeter of the coil unit 212, and is preferably affixed to the foam base 206 by means of double-sided adhesive tape 280, affixed along the junction line 281, (also denoted by hash marks) between the top side 207 of the foam base 206 and the bottom side 211 of coil unit 212 and also affixed along junction line 281*a* at the top of coil unit 212; foam layers 256 and 256*a* of a height, width and length depending upon the desired size of the mattress are prepared and an intermediate canvas layer 254*a* is then glued between the foam layers 256 and 256*a*, and this foam-canvas-foam composite is then preferably glued only to the top surface 207 of the foam base 206 by conventional water-based, non-toxic gluing materials, such as a waterborne spray adhesive e.g. SABA Superspray 3802 (manufactured by SABA Dinxperio BV, a Netherlands company), along glue line 283 (FIG. 5). No glue need be applied to the juncture of the inner canvas layer 254*b* and foam layer 256*a* of the foam-canvas-composite, this juncture line being denoted by line 259. The composite encasement 250 is completed by an outer canvas layer 254 which is wrapped around the outer foam layers 256 and 256*a* and affixed in place at the upper surface 217 of the foam-canvas-foam composite, by double-sided adhesive tape 280, along line 290, and affixed to the bottom of the foam base 206 along line 291, also by means of double-sided adhesive tape 280**.

The resulting unitary composite encasement 250 while being firm, has somewhat more flexibility and comfort than a composite encasement in which the canvas-foam components are entirely glued together by conventional gluing methods and materials In addition, from a manufacturing point of view, the use of double-sided adhesive tape is quicker and cleaner than the composite encasement in which the components are held together in their entirety by gluing.

The unitary composite encasement 250, comprising a combination of conventional gluing materials in combination with double-sided adhesive tape, results in the desired flexibility and comfort, together with the desired firmness, and is the preferred embodiment. However, other adhesive tape-glue combinations may be utilized with similar effect.

The canvas, forming the canvas layers 254, 254*a*, and 254*b*, is made of a closely woven light-weight cloth, usually made of hemp or cotton. The double-sided adhesive tape utilized comprises, preferably, a base of a synthetic fiber netting, coated on both sides with an acrylic adhesive, an example of which is APC #555 EZ-SPLICE TAPE purchased from Adhesive Products Company of Indianapolis, Ind. The foam layers 256 and 256*a*, of the foam-canvas composite encasement 250 can be made from various conventional materials such as polyurethane or other foams. Irrespective of the material, the composite encasement 250 has a resilient and firm consistency to provide sufficient structure at the perimeter of the mattress to prevent or minimize roll-off of the sleeper.

Figure 6:
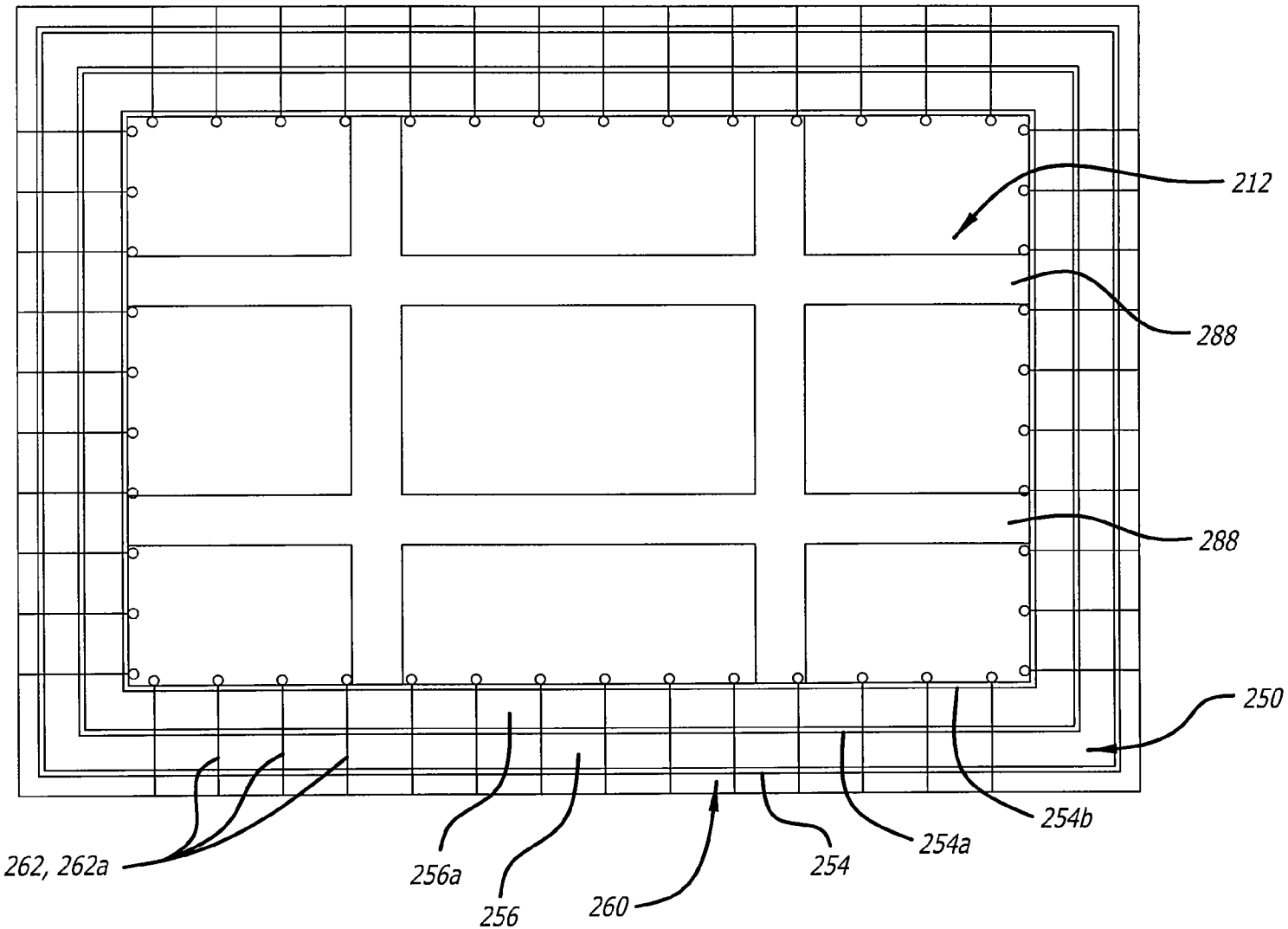
FIG. 6 is a plan view showing, in schematic form the attachment of the border assembly to the composite encasement of this invention.

As shown in FIGS. 3 and 4, as well as in FIG. 6, a pre-stitched quilted border assembly 260 is attached to encasement 250 by means of stitching thread 262 such as a lubricated polyester braided thread, an example of which is BRIO #41090 made by Coats China and purchased from Coats American, Inc. of Charlotte, N.C., USA, which thread is passed back and forth through all of the layers of the encasement, along horizontal line 264 (FIG. 3) of the border assembly, in a continuous manner, in a number of back and forth passes and then tied at desired intervals. This process of stitching the stitch thread 262 along horizontal line 264 at desired intervals is repeated until the entire border assembly 260 (FIG. 3) is thereby attached to the encasement 250. The stitching thread 262 is preferably passed through the border assembly 260 at the intersections 268 of the horizontal line 264 and vertical lines 266. A second series of multiple stitch lines 262*a* is, preferably, similarly stitched through all of the layers of the composite encasement 250 (FIG. 4) along horizontal line 264*a* (FIG. 3). A third series of multiple stitch lines may also be similarly stitched through all the layers of the composite encasement 250 (not shown).

FIG. 6 depicts, in schematic form, the coil spring unit 212 securely held in place within the composite encasement 250 by elastic bands 288. The border assembly 260 is affixed to the composite encasement 250 by means of multiple, spaced, stitch lines 262 and 262*a* which pass through the three canvas layers 254, 254*a*, and 254*b* and the two foam layers 256 and 256*a*. The canvas layers anchor and retain the stitch lines 262 and 262*a* in place and prevent cutting of the stitching thread into the foam layers, and thereby prevent the border assembly 260 from shifting over time under the weight and movement of the sleeper in the bed, and thereby maintains the edges of the composite encasement 250 in a straight line and thereby minimizes sleeper roll off. The mattress assembly is then completed, as set forth in U.S. Pat. No. 7,640,611.

Thus, it will be apparent from the foregoing that, while particular forms of the invention have been illustrated and described, various modifications can be made without departing from the spirit and scope of the invention.

We claim:

1. A mattress assembly comprising:

a base having a periphery;

a generally rectangular encasement extending upwardly from said base along the periphery of said base to define an interior cavity, the encasement having an exterior sidewall;

a border assembly affixed to the exterior sidewall of the encasement;

a spring unit secured within said interior cavity;

wherein said encasement comprises alternating layers of closely woven cloth and foam comprising:

a. an outer layer of closely woven cloth;

b. a first layer of foam;

c. an intermediate layer of closely woven cloth;

d. a second layer of foam; and e. an inner layer of closely woven cloth;

wherein at least one of the closely woven cloth layers is affixed to at least one of the first and second foam layers and the base; and multiple spaced lines of stitching extending through the border assembly and all the alternating layers of closely woven cloth and foam, to firmly secure the border assembly and said alternating layers together to form a firm, flexible composite encasement; wherein the closely woven cloth layers retain the multiple spaced lines of stitching in place within the foam layers when subjected to the weight and movement of a sleeper on the mattress.

2. A mattress assembly comprising:

a base having a periphery;

a generally rectangular encasement extending upwardly from said base along the periphery of said base to define an interior cavity; and a spring unit secured within said interior cavity;

wherein said encasement comprises alternating layers of closely woven cloth and foam comprising:

a. an outer layer of closely woven cloth;

b. a first layer of foam;

c. an intermediate layer of closely woven cloth;

d. a second layer of foam; and e. an inner layer of closely woven cloth;

wherein the intermediate closely woven cloth layer is affixed to the first and second layers of foam and wherein the encasement further comprises:

f. multiple spaced lines of stitching extending through the outer layer of closely woven cloth and through all of said alternating layers of said encasement, including the inner layer of closely woven cloth, to firmly secure the layers together to form a firm, flexible, encasement;

wherein the closely woven cloth layers retain the multiple spaced lines of stitching in place within the foam layers when subjected to the weight and movement of a sleeper on the mattress.

3. The mattress assembly of claim 2 wherein said encasement has an exterior sidewall and a border assembly is affixed to the exterior sidewall of the encasement.

4. The mattress assembly of claim 2 wherein said encasement has an exterior sidewall and a border assembly having an exterior is affixed to the exterior sidewall of said encasement by the multiple spaced lines of stitching which extend from the exterior of the border assembly through all of said alternating layers of said encasement to firmly secure said border assembly to said encasement.

5. The mattress assembly of claim 1 wherein said border assembly comprises quilted material.

6. The mattress assembly of claim 2 wherein said encasement has an exterior sidewall and a border assembly having an exterior is affixed to the exterior sidewall of said encasement by the multiple spaced lines of stitching which extend from the exterior of the border assembly through all of said alternating layers of said encasement to firmly secure said border assembly to said encasement, said border assembly comprising quilted material.

7. The mattress assembly of claim 1 wherein said border assembly comprises quilted material having horizontal stitch lines and vertical stitch lines which intersect with each other, and said multiple spaced lines of stitching extend through the intersections of said horizontal and vertical stitch lines of said quilted material.

8. The mattress assembly of claim 2 wherein said encasement has an exterior sidewall and a border assembly having an exterior is affixed to the exterior sidewall of said encasement by the multiple spaced lines of stitching which extend from the exterior of the border assembly through all of said alternating layers of said encasement to firmly secure said border assembly to said encasement, said border assembly comprising quilted material having horizontal stitch lines and vertical stitch lines which intersect with each other, and said multiple spaced lines of stitching extend through the intersections of said horizontal and vertical stitch lines of said quilted material.

9. The mattress assembly of claim 1 wherein the base comprises a foam material.

10. The mattress assembly of claim 1 wherein the base comprises a polyurethane foam.

11. The mattress assembly of claim 2 wherein the base comprises a foam material.

12. The mattress assembly of claim 2 wherein the base comprises a polyurethane foam material.

13. The mattress assembly of claim 1 wherein the closely woven cloth is made of canvas.

14. The mattress assembly of claim 2 wherein the closely woven cloth is made of canvas.

15. The mattress assembly of claim 1 wherein at least one of the closely woven cloth layers is affixed to at least one of the first and second foam layers and the base by double-sided adhesive tape.

16. The mattress assembly of claim 2 wherein at least one of the remaining closely woven cloth layers is affixed to the base by double-sided adhesive tape.

17. A mattress assembly comprising:

a base having a periphery;

a generally rectangular encasement extending upwardly from said base along the periphery of said base to define an interior cavity, the encasement having an exterior side wall;

a spring unit secured within said interior cavity; and a border assembly affixed to the exterior sidewall of the encasement, the border assembly comprising quilted material having horizontal stitch lines and vertical stitch lines which intersect with each other;

wherein the encasement comprises alternating layers of closely woven cloth and foam comprising:

an outer layer of closely woven cloth;

a first layer of foam;

an intermediate layer of closely woven cloth;

a second layer of foam; and an inner layer of closely woven cloth;

wherein at least one of the closely woven cloth layers is affixed to at least one of the first and second foam layers and the base;

multiple spaced lines of stitching extending through the border assembly at the intersections of the horizontal and vertical stitch lines of the quilted material and through all of the alternating layers of said encasement, including the inner layer of closely woven cloth, to firmly secure the border assembly and the layers together to form a firm, flexible composite encasement;

wherein the closely woven cloth layers retain the multiple lines of stitching in place within the foam layers when subjected to the weight and movement of a sleeper on the mattress; and wherein at least one of the closely woven cloth layers is affixed to at least one of the first and second foam layers and the base by double-sided adhesive tape.

18. The mattress assembly of claim 17 wherein the base comprises a foam material and the closely woven cloth comprises canvas.

* * * * *